US006904744B2

(12) United States Patent
Cauwels et al.

(10) Patent No.: US 6,904,744 B2
(45) Date of Patent: Jun. 14, 2005

(54) STEEL CORD FOR REINFORCING RUBBER ARTICLES

(75) Inventors: Hans Cauwels, Adegem (BE); Dirk Meersschaut, Ooigem (BE); Stijn Vanneste, Ingelmunster (BE)

(73) Assignee: N.V. Bekaert S.A., Zwevegem (BE)

( * ) Notice: Subject to any disclaimer, the term of this patent is extended or adjusted under 35 U.S.C. 154(b) by 0 days.

(21) Appl. No.: 10/683,124

(22) Filed: Oct. 14, 2003

(65) Prior Publication Data

US 2004/0134181 A1 Jul. 15, 2004

Related U.S. Application Data

(63) Continuation of application No. PCT/EP02/03849, filed on Apr. 8, 2002.

(30) Foreign Application Priority Data

Apr. 26, 2001 (EP) ..... 01201518

(51) Int. Cl.[7] ..... D07B 1/00
(52) U.S. Cl. ..... 57/219; 57/218; 57/311
(58) Field of Search ..... 57/210, 212, 218, 57/219, 231, 311, 902; 152/527

(56) References Cited

U.S. PATENT DOCUMENTS

| | | | | | |
|---|---|---|---|---|---|
| 5,287,691 | A | * | 2/1994 | Okamoto et al. | 57/236 |
| 5,321,941 | A | * | 6/1994 | Bollen et al. | 57/213 |
| 5,606,852 | A | * | 3/1997 | Yanagisawa | 57/207 |
| 5,661,965 | A | * | 9/1997 | Yanagisawa | 57/213 |
| 5,687,557 | A | * | 11/1997 | De Vos et al. | 57/214 |
| 5,968,651 | A | * | 10/1999 | De Vos et al. | 428/377 |
| 6,065,518 | A | * | 5/2000 | Miyawaki et al. | 152/454 |
| 6,076,344 | A | * | 6/2000 | Doujak | 57/9 |
| 6,311,466 | B1 | * | 11/2001 | De Vos et al. | 57/212 |
| 6,354,068 | B1 | * | 3/2002 | Onuma et al. | 57/212 |
| 6,405,774 | B1 | * | 6/2002 | Komatsu | 152/556 |
| 6,412,263 | B1 | * | 7/2002 | Lee et al. | 57/210 |
| 2002/0038538 | A1 | * | 4/2002 | Noferi | 57/58.49 |

FOREIGN PATENT DOCUMENTS

| | | | | |
|---|---|---|---|---|
| EP | 619398 A1 | * | 10/1994 | D07B/1/06 |
| GB | 2 098 251 A | | 11/1982 | |
| JP | 05279973 A | * | 10/1993 | D07B/1/06 |
| WO | 99 28547 A | | 6/1999 | |

OTHER PUBLICATIONS

International Search Report for application No. PCT/EP02/03849 to N.V. Bekaert S.A., filed Apr. 26, 2001, dated Aug. 8, 2002 (3 pages).

Patent Abstract of Japan, vol. 17, No. 243, May 17, 1983 for JP 04 370283, published Feb. 10, 1995, 2 pages, downloaded Oct. 28, 2003 from jpo.go.jp.

Patent Abstract of Japan, for JP 07–042089 to Tokyo Seiko Co. Ltd., 2 pages, downloaded from jpo.go.jp on Oct. 28, 2003.

Patent Abstract of Japan, for JP 06–073672 to Tokyo Seiko Co. Ltd., 2 pages, downloaded from jpo.go.jp on Oct 28, 2003.

— International Search Report, dated Aug. 8, 2002 for PCT/EP02/03849 to N.V. Bekaert S.A. et al., filed, Apr. 8, 2002, 3 pages.—

* cited by examiner

*Primary Examiner*—John J. Calvert
*Assistant Examiner*—Shaun R Hurley
(74) *Attorney, Agent, or Firm*—Shlesinger, Arkwright & Garvey LLP

(57) ABSTRACT

Steel cord includes a first group and a second group. The second group is helically twisted around the first group with a cord twisting step. The first group includes a first number of first steel filaments. The first number ranges between three and eight. The second group comprises a second number of second steel filaments. The second number is equal to or greater than the first number. The first filaments having a twist step greater than 300 mm. At least one of the second filaments is polygonally performed in order to allow rubber penetration.

9 Claims, 2 Drawing Sheets

STEEL CORD FOR REINFORCING RUBBER ARTICLES

CROSS-REFERENCE TO RELATED APPLICATIONS

This application is a continuation of U.S. application Ser. No. PCT/EP02/03849, filed Apr. 8, 2002, which U.S. application Ser. No. PCT/EP02/03849 claims the priority of European application No. 01201518.6, filed Apr. 26, 2001, and each of which is incorporated herein by reference.

FIELD OF THE INVENTION

The present invention relates to a steel cord comprising a first group of first steel filaments and a second group of second steel filaments. The second group is helically twisted around the first group.

BACKGROUND OF THE INVENTION

Steel cords with twisted steel filaments are known in the art, particularly in the art of rubber reinforcement, and more particularly in the art of tire reinforcement.

A 3+9+15 steel cord has been and still is a widely used steel cord, used amongs others, to reinforce the breaker or belt layers of truck tires.

An example of this 3+9+15 cord is following construction:

3×0.22+9×0.22+15×0.22+0.15 6.3/12.5/18/3.5 S/S/Z/S

Notwithstanding this widely spread use, this 3+9+15 cord has a number of drawbacks.

A first drawback is that the way of manufacturing such a 3+9+15 cord is not economical. Indeed at least two to four different twisting steps are required to manufacture the final cord.

In a first step, the three core filaments must be twisted. In a second step, the nine intermediate layer filaments are twisted around the core filaments. In a third step the fifteen outer layer filaments are twisted around the intermediate layer filaments. As a fourth step, an additional filament is wrapped around the cord.

In the usual embodiments of a 3+9+15 cord, the two different twisting directions, S and Z, are used in order to reach a torsion balance in the cord. In the examples given hereabove, the three core filaments and the nine intermediate layer filaments have been twisted in the S-direction and the fifteen outer layer filaments have been twisted in the Z-direction. If a double-twisting apparatus is used in all the steps to manufacture such a cord, this means that the subsequent twisting in Z-direction of the fifteen outer filaments partially untwists the earlier given twists in S-direction. This means a loss of energy during the manufacturing and accentuates again the non-economical way of manufacturing such a 3+9+15 cord.

A second drawback is that a 3+9+15 steel cord has no full rubber penetration. As a consequence humidity may reach the individual steel filaments during use, which may drastically decrease the life time of the steel cord and of the reinforced tire.

Numerous attempts have been made to avoid the above drawbacks and to find an improved alternative for this 3+9+15 construction.

Some attempts were directed towards providing a steel cord construction which was more economical to manufacture. An example is a 3+9+15 cord where all the layers have been twisted in the same direction. Another example is a so-called 1×27 compact cord, where all filaments have been twisted in the same direction with the same twisting step. These attempts lead to more economical cords but do not solve the problem of rubber penetration.

Other attempts were directed towards providing a steel construction with an improved rubber penetration.

An example is a $3\times d_1+9\times d_2+15\times d_3$ cord where the three core filaments have a filament diameter d1 which is greater than the filament diameter $d_2$ of the intermediate layer filaments, and where the filament diameter $d_2$ of the intermediate layer filaments is greater or equal to the filament diameter $d_3$ of the outer layer filaments. The use of the thicker filaments in the center of the cord, lead to more space available for the layers and to unsaturated layers with spaces between the filaments.

Another example is 3+8+13 cord, i.e. a cord where the intermediate layer and the outer layer are no longer saturated with the maximum number of possible filaments. One or more filaments are omitted from the intermediate or outer layer and lead to spaces between the filaments so that rubber is able to penetrate.

Still another example are 3+9+15 cords where at least one filament in each layer, i.e. in the core, in the intermediate layer and in the outer layer are preformed so that they exhibit a wavy form. The wavy filament creates more space between the filament and the adjacent filaments and allows rubber to penetrate.

Following steel cord constructions are also widely used as reinforcement for the breaker or belt layer of a truck tire:

3×0.20+6×0.35

3×0.35+8×0.35.

These constructions, however, suffer from the same drawbacks as the 3+9+15 construction. Two twisting operations are required to manufacture the cord and complete rubber penetration is not obtained.

SUMMARY OF THE INVENTION

It is an object of the present invention to avoid the drawbacks of the prior art.

It is another object of the present invention to provide an alternative cord for a 3+9+15 steel cord, a 3+6 cord or for a 3+8 cord.

It is still an object of the present invention to provide a steel cord with a full rubber penetration.

It is yet another object of the present invention to provide a steel cord which can be made in an economical way.

According to the invention there is provided a steel cord which comprises a first group and a second group. The second group is helically twisted around the first group with a cord twisting step. The first group comprises a first number of first steel filaments where the first number ranges between three and eight. The second group comprises a second number of second steel filaments. The second number is equal to or, preferably, greater than the first number. The first filaments have a length of lay or twisting step greater than 300 mm and are preferably untwisted (infinite length of lay or twisting step). At least one of the second filaments is polygonally preformed. More than one of the second filament can be polygonally preformed. Prefably all the second filament can be polygonally preformed.

The technique of polygonal preforming is disclosed in U.S. Pat. No. 5,687,557 and is incorporated herein by reference.

As will be explained hereinafter such a steel cord can be manufactured in one single twisting step. The polygonal preforming of the second filaments gives an open structure to the steel cord and allows rubber or other matrix material to penetrate until the first group.

Preferably the second filaments are twisted around each other with a twisting step, hereinafter referred to as the group twisting step. This group twisting step is preferably equal to the cord twisting step. As will be explained hereinafter, this preferable embodiment may be obtained in one single step by means of a double-twisting apparatus.

In order to promote penetration of rubber or of another matrix material inside the first group of filaments or in order to obtain predetermined elongation features, at least one of the first filaments is preformed so that it has a wavy form. More than one of the first filaments and preferably all of the first filaments may be preformed so that they have a wavy form. This spatial wave form can be a helical form. However, this wavy form is preferably a spatial wave form, i.e. the wave is not a planar wave but has dimensions outside a single plane. Preferably this spatial wave form has a first crimp and a second crimp. The first crimp lies in a plane which is substantially different from the plane of the second crimp.

Prior art documents JP-A-04-370283, JP-A-06-073672 and JP-A-07-042089 all disclose steel cords which comprise two groups of steel filaments where one group is helically twisted around the other.

The JP-A-04-370283 steel cord has a first group of only two first filaments and a second group of N second filaments with N equal to two or three. The N second filaments are preformed so that they exhibit a wavy form.

The JP-A-06-073672 steel cord has a first group of two first filaments and a second group of two second filaments. The first filaments are preformed so that they exhibit a wavy form.

The JP-A-07-042089 steel cord first group of two first filaments and a second group of two or three second filaments. The first filaments are preformed so that they exhibit a wavy form so that the first filaments have the same length as the second filaments in the steel cord.

None of the JP-A04-370283, JP-A-06-073672 or JP-A-07-042089 steel cords, however, can replace a 3+9+15, a 3+6 or a 3+8 construction with the same reinforcing effect.

In a preferable embodiment of the present invention, the first number of first filaments ranges from three to five and the second number of second filaments ranges from four to eight. For example the first number is equal to four and the second number is equal to six.

BRIEF DESCRIPTION OF THE DRAWINGS

The invention will now be described: into more detail with reference to the accompanying drawings wherein FIG. 1 schematically illustrates the way in which a steel cord according to the invention is manufactured.

DESCRIPTION OF THE PREFERRED EMBODIMENTS OF THE INVENTION

A steel cord according to the invention is preferably made as follows. Starting product is a wire rod with a rod diameter ranging from 5.5 mm to 6.5 mm. The steel composition of this rod generally comprises a minimum carbon content of 0.60% (e.g. at least 0.80%, or at least 0.92% with a maximum of 1.2%), a manganese content ranging from 0.20 to 0.90% and a silicon content ranging from 0.10 to 0.90%; the sulphur and phosphorous contents are each preferably kept below 0.03%; additional elements such as chromium (up to 0.2 a 0.4%), boron, copper, cobalt, nickel, vanadium . . . may be added to the composition in order to minimize the amount of deformation needed to obtain a predetermined tensile strength.

The wire rod is dry drawn through a number of subsequent drawing dies until steel wire with an intermediate diameter is obtained. This dry drawing may be interrupted by an intermediate patenting treatment in order to obtain a metallic structure which is suitable to be drawn further.

At the intermediate diameter the steel wire is preferably coated with a metallic coating. The exact type of coating depends upon the eventual application. This coating may be a corrosion resistant coating such as zinc or a coating that promotes the adhesion to the matrix material such as brass in the case of rubber, or a so-called ternary brass such as copper-zinc-nickel (e.g. 64%/35.5%/0.5%) and copper-zinc-cobalt (e.g. 64%/35.7%/0.3%), or a copper-free adhesion layer such as zinc-cobalt or zinc-nickel.

The steel wire with the metallic coating is further wet drawn until a final filament with a filament diameter. The exact value of this final diameter also depends upon the eventual application. Generally, the filament diameter ranges from 0.03 mm to 1.10 mm, more specifically from 0.15 mm to 0.60 mm, e.g. from 0.20 mm to 0.45 mm.

The final tensile strength of the steel filament may vary dependent upon the initial steel rod composition, the degree of deformation and the value of the filament diameter.

Preferably the steel filament has a high tensile strength. This is a tensile strength TS above the following minimum values:

$$TS > 2250 - 1150 \times \log d \ MPa$$

where d is the filament diameter in mm.

As such steel filaments may have a tensile strength up to 4000 MPa and even higher.

Figure 1:
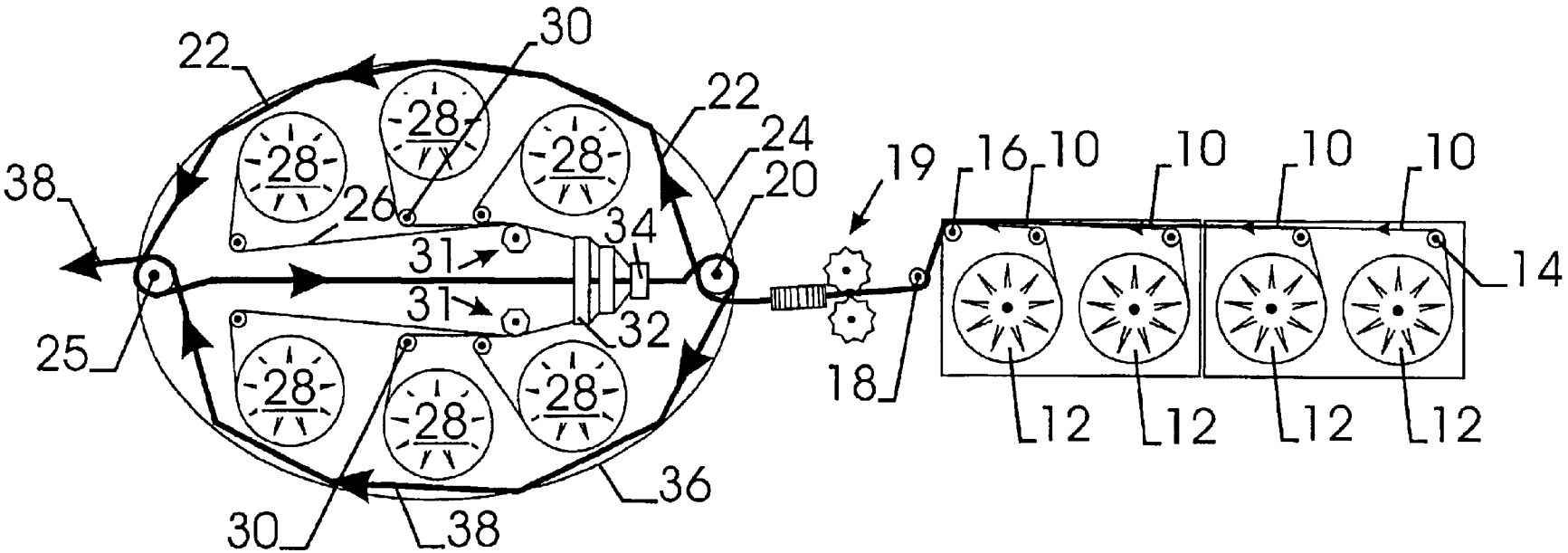

The final twisting operation will be explained with reference to FIG. 1. Starting from the right side of FIG. 1, four first steel filaments 10 with a diameter of 0.38 mm are unwound from supply spools 12 and guided via guiding wheels 14, 16 and 18 towards a two pairs of toothed wheels 19 which give to the first steel filaments 10 a first crimp and a second crimp. The first crimp lies in a plane which is different from the plane of the second crimp.

The technique of double-crimping is disclosed in WO-A-99/28547.

The bundle 22 of double-crimped first steel filaments 10 is then guided via pulley 20 over a first flyer 24 of a double-twisting apparatus. The direction of bundle 22 is reversed over pulley 25, after which the bundle 22 enters the double-twisting apparatus centrally. During its traveling over flyer 24 and just thereafter, the bundle 22 of double-crimped first filaments 10 has received two twits.

Six second steel filaments 26 with a filament diameter of 0.38 mm are unwound from supply spools 28 inside the double-twisting apparatus. The six second steel filaments are guided over guiding wheels 30 towards a preforming device 31 which give to the second steel filaments 26 a polygonal preforming. The thus polygonally preformed second steel filaments 26 are further guided over distribution disc 32 towards a cord forming die 34 where the second steel filaments 26 come together with the bundle 22 of first steel filaments 10. The bundle 22 first steel filaments 10 and the second steel filaments 26 are then reversed via pully 20 towards the second flyer 36 of the double-twisting apparatus. During their travelling over the second flyer 36 and just thereafter, the final invention steel cord 38 is formed: bundle 22 of first steel filaments 10 is untwisted and the second steel filaments 26 are twisted. The result is a steel cord 38 which meets following formula:

4×0.38+6×0.38 22/S

The group twisting step equals the cord twisting step and is about 22 mm.

Generally the group twisting step and the cord twisting step may vary between 30 times the filament diameter and 150 times the filament diameter, e.g. between 50 times and 70 times the filament diameter, although values outside these ranges are not excluded.

Table 1 hereunder summarizes some properties of this steel cord 38.

TABLE 1

| Property | Dimension | Value |
|---|---|---|
| Linear density | (g/m) | 8.95 |
| diameter | (mm) | 1.64 |
| Breaking load (bare) | (N) | 2900 |
| Breaking strength (bare) | (MPa) | 2550 |
| Breaking load (embedded) | (N) | 2960 |
| Breaking strength (embedded) | (MPa) | 2600 |
| Rubber penetration | (%) | 100 |
| Bending stiffness | ($Nmm^2$) | 2135 |

Figure 2:
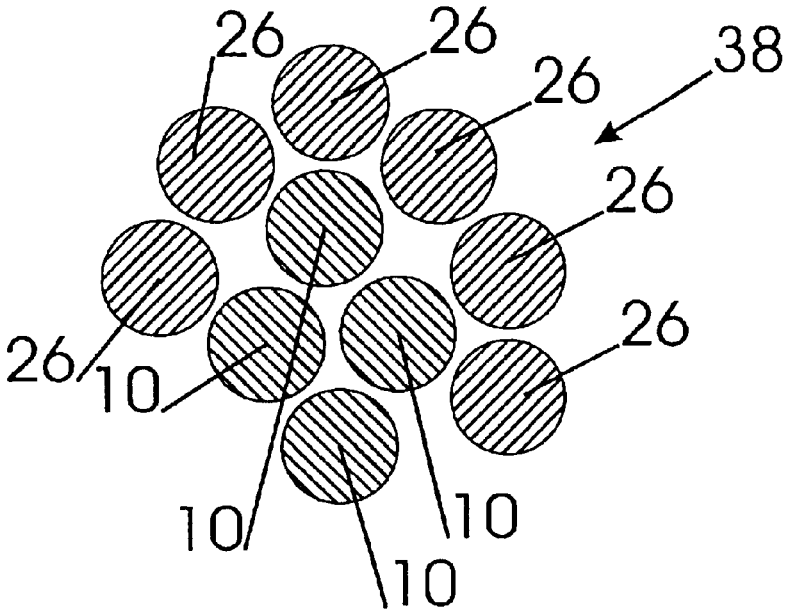
FIG. 2 illustrates a actual cross-section of a steel cord according to the invention.

FIG. 2 shows an actual cross-section of a steel cord 38. The steel cord 38 has a first group of four first steel filaments 10 more or less parallel and untwisted. Spaces are available between the steel filaments 10 as a consequence of the double crimp. As a result rubber is able to penetrate inside the first group. A second group of six second steel filaments 26 is twisted round the first group. The six second steel filaments 26 have been polygonally preformed to allow rubber to penetrate through the second group and reach the first group.

Figure 3:
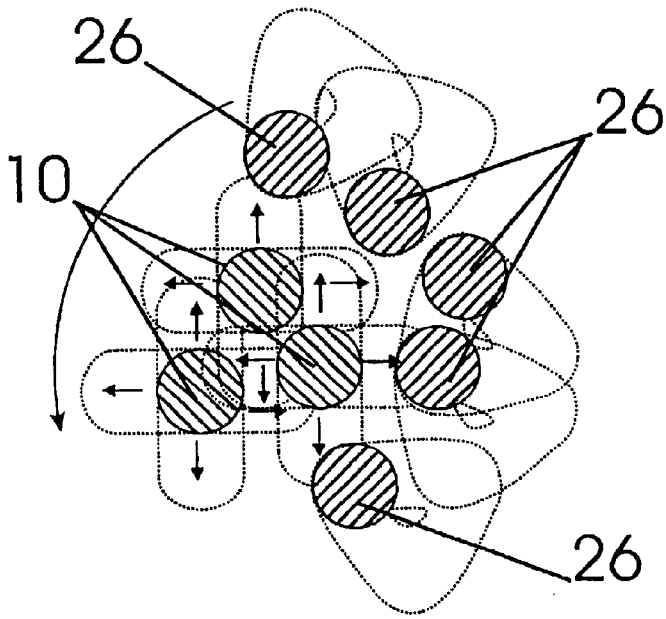
FIG. 3 illustrates a cross-section of a steel cord according to a principle of the invention.

FIG. 3 shows schematically a 3+5 steel cord 38 according to the invention. Steel cord 38 has a first group of three first filaments 10 which have a spatial wave form so that spaces are created inside the first group. This is illustrated by means of the dotted lines around each first filament 10. A second group of five second steel filaments 26 is twisted around the first group. The second steel filaments 26 have been polygonally preformed so that spaces are created between the second filaments and between the first group and the second group.

Next to the embodiments illustrated in FIG. 2 and in FIG. 3, other embodiments of the invention steel cord are possible. Some examples are:

3+4
3+6
3+7
3+8
4+5
4+7
4+8
5+6
5+7
5+8
6+6
6+7
6+8

The filament diameter of the first and second steel filaments does not need to be the same. Even the filament diameter may vary inside a group, which means that the first group may comprise first steel filaments with a different diameter and that the second group may comprise second steel filaments with a different diameter.

Although the invention steel cord is particularly suitable for the reinforcement of the breaker or belt layer of truck tires, other applications where full rubber penetration or full impregnation with plastic are required or preferred, are possible.

What is claimed is:

1. A steel cord, comprising:

a) a first group and a second group;

b) said second group being helically twisted around said first group with a cord twisting step;

c) said first group including a first number of first steel filaments, and said first number ranging between three and eight;

d) said second group including a second number of second steel filaments, and said second number being one of equal to and greater than said first number;

e) said first filaments having a twisting step greater than 300 mm; and f) at least one of said second filaments being polygonally preformed.

2. A steel cord according to claim 1, wherein:

a) said second filaments are twisted around each other with a group twisting step.

3. A steel cord according to claim 2, wherein:

a) said group twisting step is equal to said cord twisting step.

4. A steel cord according to claim 1, wherein:

a) said second number is greater than said first number.

5. A steel cord according to claim 1, wherein:

a) at least one of said first steel filaments is preformed so that it has a wavy form.

6. A steel cord according to claim 5, wherein:

a) said wavy form is a spatial wavy form.

7. A steel cord according to claim 6, wherein:

a) said spatial wavy form has a first crimp and a second crimp, the first crimp lying in a plane that is substantially different from the plane of the second crimp.

8. A steel cord according to claim 7, wherein:

a) said first number ranges from three to five; and b) said second number ranges from four to eight.

9. A steel cord according to claim 8, wherein:

a) said first number is equal to four; and b) said second number is equal to six.

* * * * *